US011732342B2

(12) United States Patent
Nakamoto et al.

(10) Patent No.: US 11,732,342 B2
(45) Date of Patent: Aug. 22, 2023

(54) METHOD FOR CARBURIZING STEEL MEMBER, STEEL COMPONENT, AND CARBURIZING AGENT

(71) Applicant: NSK LTD., Tokyo (JP)

(72) Inventors: Tomoyuki Nakamoto, Kanagawa (JP); Yuuji Miyamoto, Kanagawa (JP)

(73) Assignee: NSK LTD, Tokyo (JP)

( * ) Notice: Subject to any disclaimer, the term of this patent is extended or adjusted under 35 U.S.C. 154(b) by 0 days.

(21) Appl. No.: 18/018,163

(22) PCT Filed: Jan. 14, 2022

(86) PCT No.: PCT/JP2022/001236
§ 371 (c)(1),
(2) Date: Jan. 26, 2023

(87) PCT Pub. No.: WO2022/154105
PCT Pub. Date: Jul. 21, 2022

(65) Prior Publication Data

US 2023/0227958 A1 Jul. 20, 2023

(30) Foreign Application Priority Data

Jan. 14, 2021 (JP) ..... 2021-004298

(51) Int. Cl.
*C23C 8/66* (2006.01)

(52) U.S. Cl.
CPC ..... *C23C 8/66* (2013.01)

(58) Field of Classification Search
CPC ..... C23C 8/66
See application file for complete search history.

(56) References Cited

FOREIGN PATENT DOCUMENTS

| | | | | |
|---|---|---|---|---|
| CN | 109136484 | A | 1/2019 | |
| JP | 5-222411 | A | 8/1999 | |
| JP | 6194057 | B2 | 9/2017 | |
| JP | 6321982 | B2 | 5/2018 | |
| JP | 2018-204085 | A | 12/2018 | |
| WO | WO-2015037509 | A1 * | 3/2015 | ..... B22F 5/106 |

OTHER PUBLICATIONS

Communication dated Jun. 7, 2022 by the Japanese Patent Office for Japanese Patent Application No. 2022-524255.

(Continued)

*Primary Examiner* — Jessee R Roe
(74) *Attorney, Agent, or Firm* — Sughrue Mion, PLLC

(57) ABSTRACT

A method for carburizing a steel member of the present invention includes: bringing a carburizing agent into contact with at least a part of a surface of a steel member; and heating the steel member and the carburizing agent to allow carbon to penetrate into at least a part of the surface, in which the carburizing agent contains a Fe-C alloy powder, a graphite powder in an amount of 20% by volume or more and 70% by volume or less relative to a total volume of the carburizing agent, and a binder that binds the Fe-C alloy powder and the graphite powder to each other, and in the heating, a heating temperature is held for a certain period of time within a temperature range of an austenite region of a eutectic point of the steel member or higher and lower than the peritectic point of the steel member.

10 Claims, 7 Drawing Sheets

(56) References Cited

OTHER PUBLICATIONS

Search Report (PCT/ISA/210) dated Apr. 5, 2022 by the International Searching Authority for International Patent Application No. PCT/JP2022/001236.
Written Opinion (PCT/ISA/237) dated Apr. 5, 2022 by the International Searching Authority for International Patent Application No. PCT/JP2022/001236.

* cited by examiner

METHOD FOR CARBURIZING STEEL MEMBER, STEEL COMPONENT, AND CARBURIZING AGENT

CROSS REFERENCE TO RELATED APPLICATIONS

This application is a National Stage of International Application No. PCT/JP2022/001236 filed on Jan. 14, 2022 claiming priority from Japanese Patent Application No. 2021-004298 filed on Jan. 14, 2021, the disclosures of which are incorporated herein in their entirety by reference.

TECHNICAL FIELD

The present invention relates to a method for carburizing a steel member, a steel component, and a carburizing agent. The steel member constitutes a tapered roller bearing, a cylindrical roller bearing, a spherical roller bearing, or the like, which are used for a steelmaking facility, an excavation machine, a wind power generator, or the like.

BACKGROUND ART

In general, regarding a machine component such as a gear and a bearing, carburizing and quenching are used to increase the hardness in the vicinity of a surface (for example, a depth of about 1 mm from the surface in the case of a small product) and improve various properties such as wear resistance, slidability, and fatigue strength. The methods for carburizing are classified into solid carburizing, liquid carburizing, gas carburizing, and vacuum carburizing. AU the carburizing methods are a treatment for causing carbon (C) to penetrate from a surface of a component heated to the austenite region.

Since gas carburizing is used in most industrially carburizing, gas carburizing will be specifically described below. FIG. 6 is a schematic view illustrating a carburizing mechanism of a gas carburizing method. FIG. 7 is a Fe-C binary phase diagram in which a vertical axis represents temperature and a horizontal axis represents C content.

As shown in FIG. 6, a steel member 21 is placed in a furnace heated to a temperature equal to or higher than the $A_1$ line (727° C.) shown in the phase diagram of FIG. 7, and a gas atmosphere (carburizing atmosphere) is formed in which an endothermic metamorphic gas containing CO, $N_2$, and $H_2$ as main ingredients flows as a carrier gas, and a hydrocarbon gas such as propane and butane is further supplied as an enriched gas. Accordingly, carbon (C) can penetrate from a surface 21*a* of the steel member 21, At this time, carbon dioxide ($CO_2$) is generated.

The required carburizing depth is determined according to a size'of the steel member 21, chemical ingredients of a steel material constituting the steel member 21, and use conditions of a product for which the steel member 21 is used, so that each component is treated for a carburizing time that results in the desired depth. Among large bearings mainly targeted by the present invention, for example, in the case where a bearing ring and a rolling element of an ultra-large, roller bearing for industrial machines, which have an outer diameter of more than 1000 mm, are subjected to a carburizing treatment, a carburizing depth of more than 15 mm from a surface of each member may be required in order to ensure rolling fatigue strength under a large load. Therefore, for example, in a case where the treatment is performed according to the gas carburizing method at a temperature of 950° C, a treatment for a long time of 200 to 300 hours is required. As described above, when a gas carburizing method according to the related art is used, the lead time of the carburizing treatment becomes the maximum neck step, and thus the shortening of the treatment time is required.

Therefore, Patent Literature 1 discloses a method for carburizing a steel component, by which a sufficient carburizing depth can be obtained in a wide range in a rolling bearing in a shorter carburizing time. This method for carburizing is a method in which a carburizing agent obtained by mixing a powdery fe-C alloy and sodium silicate for binding powders to each other is brought into contact with a surface with a steel component, and in this state, they are held for a certain period of time in a temperature range of an austenite region equal to or higher than a eutectic point of a constituent component and lower than a peritectic point thereof.

Patent Literature 1 states that a carburizing treatment (at 1200° C for 30 minutes) is performed using a carburizing agent obtained by mixing Fe-3.1C % powder and a sodium silicate aqueous solution (10 wt. %), whereby a carburizing rate constant K in an experimental formula ($x=K\sqrt{t}$) of F. E. Harris becomes 2.69. This value indicates rapid carburizing with respect to K=0.74 under gas carburizing conditions (Cp: 1.05, at 950° C. for 5 hr) and indicates that a carburizing treatment is significantly efficient.

In the case where the carburizing treatment described in Patent Literature 1 is performed, a step of removing the carburizing agent from the component after the carburizing may be necessary. When the number of steps increases, the production cost may increase.

Therefore, there is a demand for development of a carburizing agent that can be easily removed from a component after a carburizing treatment.

Patent Literature 2 discloses a surface treatment method of spray-coating a surface of a steel with a surface treatment agent containing a carbon powder (graphite powder), a carbonate (at least one selected from calcium carbonate and barium carbonate), a metal oxide (at least one selected from aluminum oxide and titanium oxide), and a sodium silicate solution. According to this surface treatment method, a selective carburizing treatment can be performed by utilizing spray coating.

According, to the surface treatment method, a carbon dioxide gas ($CO_2$) is generated by decomposing the carbonate under a high-temperature environment, carbon monoxide (CO) is generated by reacting the carbon dioxide gas with carbon (C) in the carbon powder, and a carburizing action is caused by bringing the carbon monoxide gas into contact with the steel. In addition. Patent Literature 2 states that a metal oxide has a function of diluting carbon powder or carbonate, and makes it easy to remove a carburizing agent after a carburizing treatment.

Further, Patent Literature 3 proposes a surface treatment method for a metal material into which carbon is diffused and permeated from a surface thereof by heating the metal material in a state in which the metal material is embedded in a modifier powder containing iron, in which the surface treatment is performed while carbon is supplemented to the modifier powder from a carbon supplementing source provided apart from the metal material. According to such a surface treatment method, since there is a carbon supplementing source provided apart from the metal material, a shortage of carbon around the metal material is compensated, and the modifier powder can be repeatedly used without lowering the surface treatment capacity.

CITATION LIST

PATENT LITERATURE

Patent Literature 1: JP-A-2018-204085
Patent Literature 2: Japanese Patent No. 6194057
Patent Literature 3: Japanese Patent No. 6321982

SUMMARY OF INVENTION

PROBLEM

However, when spray coating is used as described in Patent Literature 2, there is a limit to the thickness of the carburizing agent that can be applied to the metal surface, and it is particularly difficult to obtain a carburizing depth required for a large bearing. In addition, when the entire surface of the component is carburized and the spray coating is used, unevenness occurs in the amount of the carburizing agent to be applied, and a uniform carburized layer cannot be obtained. Further, the melting points of calcium carbonate and barium carbonate used as the carbon salt are 800° C. to 850° C., and when the treatment is performed at a eutectic point or higher, calcium carbonate and barium carbonate are melted, so that a carburizing agent having a uniform carbon concentration cannot be held, and unevenness may occur in carburizing.

In addition, according to the surface treatment method described in Patent Literature 3, the adhesion between the metal material and the modifier powder is low, and thus unevenness of carburizing may occur.

The present invention has been made in view of the above problems, and an object of the present invention is to provide a method for carburizing a steel member by which a carburized layer having a desired uniform depth can be formed on a surface of the steel member in an extremely short treatment time and a carburizing agent after the carburizing can be easily removed.

Another object of the present invention is to provide a steel component whose surface is uniformly carburized at a desired depth.

Still another object of the present invention is to provide a carburizing agent by which a carburized layer having a desired uniform depth can be formed on a surface of the steel component in an extremely short treatment time and a carburizing agent after the carburizing can be easily removed.

SOLUTION TO PROBLEM

The above object of the present invention is achieved by the following configuration <1> related to a method for carburizing a steel member.

<1> A method for carburizing a steel member, the method including:

bringing a carburizing agent into contact with at least a part of a surface of a steel member; and heating the steel member and the carburizing agent to allow carbon to penetrate into at least a part of the surface of the steel member, in which the carburizing: agent contains, a Fe-C alloy powder, a graphite powder in an amount of 20% by volume or more and 70% by volume or less relative to a total volume of the carburizing agent, and a binder that binds the Fe-C alloy powder and the graphite powder to each other, and in the heating, a heating temperature is held for a certain period of time within a temperature range of an austenite region equal to or higher than a eutectic point of the steel member and lower than a peritectic point of the steel member.

In addition, a preferred embodiment of the present invention related to the method for carburizing a steel member relates to the following <2> to <4>.

<2> The method for carburizing a steel member according to <1>, in which the Fe-C alloy powder is in a mixed state of a solid phase and a liquid phase or in a liquid-phase state at a temperature equal to or higher than the eutectic point of the steel member, and the graphite powder is in a solid-phase state at a temperature equal to or higher than the eutectic point of the steel member.

<3> The method for carburizing a steel member according to <1> or <2>, in which the binder contains at least one of sodium silicate and calcium sulfate.

<4> The method for carburizing a steel member according to any one of <1> to <3>, in which the heating is performed in an inert gas atmosphere.

The above object of the present invention is achieved by the following configuration <5> related to a steel component.

<5> A steel component obtained by bringing a carburizing agent into contact with at least a part of a surface of a steel member, and allowing carbon to penetrate into at least a part of the surface by heating the steel member and the carburizing agent, in which the carburizing agent contains a Fe-C alloy powder, a graphite powder in an amount of 20% by volume or more and 70% by volume or less relative to a total volume of the carburizing agent, and a binder that binds the Fe-C alloy powder and the graphite powder to each other, and a temperature in the heating is in an austenite region equal to or higher than a eutectic point of the steel component and lower than a peritectic point of the steel component, and the steel component is held at the heating temperature for a certain period of time.

In addition, the above object of the present invention is achieved by the following configuration <6> related to a carburizing agent.

<6> A carburizing agent for use in the method for carburizing a steel member according to any one of <1> to <4> the carburizing agent containing:

a Fe-C alloy powder; a graphite powder in an amount of 20% by volume or more and 70% by volume or less relative to a total volume of the carburizing agent; and a binder that binds the Fe-C alloy powder and the graphite powder to each other.

In addition, the above object of the present invention is achieved by the following 25 configuration <7> related to a method for carburizing a steel member.

<7> A method for carburizing a steel member, the method including:

bringing a carburizing agent into contact with at least a part of a surface of a steel member; and heating the steel member and the caburizing agent to allow carbon to penetrate into at least a part of the surface, in which the carburizing agent contains a Fe-C alloy powder, a graphite powder in an amount of 5% by mass or more and 60% by mass or less relative to a total mass of the carburizing agent, and a binder that binds the Fe-C alloy powder and the graphite powder to each other, and in the heating, a heating temperature is held for a certain period of time within a temperature range of an austenite region equal to or higher than a eutectic point of the steel member and lower than a peritectic point of the steel member.

In addition, a preferred embodiment of the present invention related to the method for carburizing a steel member relates to the following <8> to <10>, <8> The method for carburizing a steel member according to <7>, in which the Fe-C alloy powder is in a mixed state of a solid phase and a liquid phase or in a liquid-phase state at a temperature equal to or higher than the eutectic point of the steel member, and the graphite powder is in a solid-phase state at a temperature equal to or higher than the eutectic point of the steel member.

<9> The method for carburizing a steel member according to <7> or <8>, in which the hinder contains at least one of sodium silicate and calcium sulfate.

<10> The method for carburizing a steel member according to an one of <7> to <9>, in which the beating step is performed in an inert gas atmosphere.

In addition, the above object of the present invention is achieved by the following configuration [<11> related to a steel component.

<11> A steel component obtained by bringing a carburizing agent into contact with at least a part of a surface of a steel member, and allowing carbon to penetrate into at least a part of the surface by heating the steel member and the carburizing agent, in which Me carburizing agent contains a Fe-C alloy powder, a graphite powder in an amount of 5% by mass or more and 60% by mass or less relative to a total mass of the carburizing agent, and a binder that binds the Fe-C alloy powder and the graphite powder to each other, a temperature of the heating is in an austenite region equal to or higher than a eutectic point of the steel component and lower than a peritectic point of the steel component, and the steel component is held at the heating temperature for a certain period of time.

In addition, the above object of the present invention is achieved by the following configuration <12> related to a carburizing agent.

<12> A carburizing agent for use in the method for carburizing a steel member according to any one of <7> to <10>, the carburizing agent containing:

a Fe-C alloy powder; a graphite powder in an amount of 5% by mass or more and 60% by mass or less relative to a total mass of the carburizing agent; and a binder that binds the Fe-C alloy powder and the graphite powder to each other.

ADVANTAGEOUS EFFECTS OF INVENTION

According to the present invention, it is possible to provide a method for carburizing a steel member, a steel component obtained by using the method for carburizing a steel member, and a carburizing agent used in the method for carburizing a steel member, by which a carburized layer having a desired uniform depth can be formed on a surface of the steel member in an extremely short treatment time and a carburizing agent after the carburizing can be easily removed.

DESCRIPTION OF EMBODIMENTS

Hereinafter, embodiments of the present invention will be described in detail. The present invention is not limited to the embodiments described below.

[1. Method for Carburizing Steel Member]

A method for carburizing a steel member according to the present embodiment includes bringing a carburizing agent into contact with at least a part of a surface of the steel member, and heating the steel member and the carburizing agent to allow carbon to penetrate into at least the part of the surface. In addition, the carburizing agent may contain a Fe-C alloy powder, a graphite powder in an amount of 20% by volume or more and 70% by volume or less relative to a total volume of the carburizing agent, and a binder that binds the Fe-C alloy powder and the graphite powder to each other. The carburizing agent may contain a Fe-C alloy powder, a graphite powder in an amount of 5% by mass or more and 60% by mass or less relative to the total mass of the carburizing agent, and a binder that binds the Fe-C alloy powder and the graphite powder to each other. Further, in the heating, a heating temperature is held for a certain period of time within a temperature range of an austenite region that is equal to or higher than the eutectic point and is lower than the peritectic point. Sodium silicate as the binder may be in the form of a solution (aqueous solution, water glass) or in the form of a powder or the like.

A method for carburizing a steel member according to the present embodiment will be specifically described below with reference to the drawings.

Figure 1A:
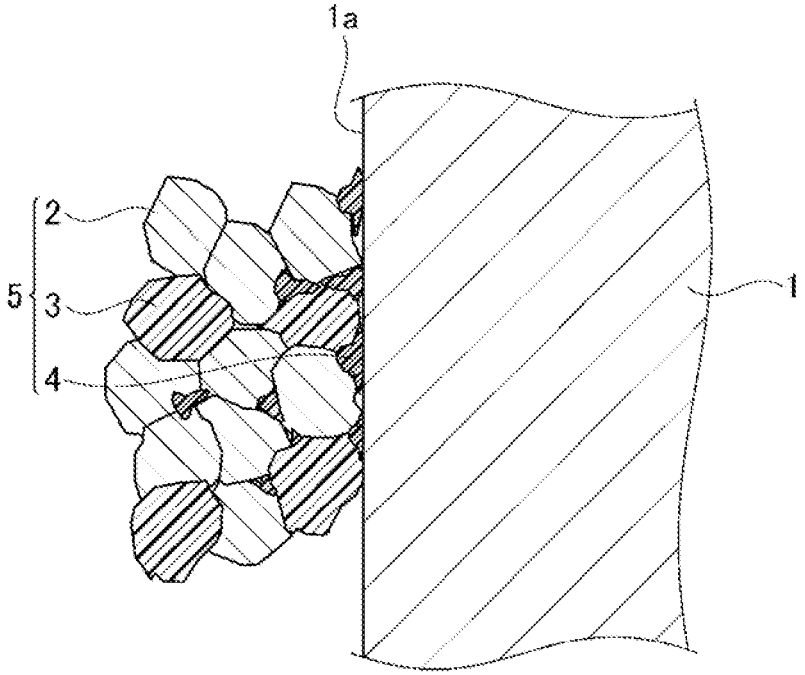
FIG. 1A is a schematic view illustrating a method for carburizing a steel member according to an embodiment of the present invention, and is a view illustrating a state in which a carburizing agent is placed on a surface of the steel member.
Figure 1B:
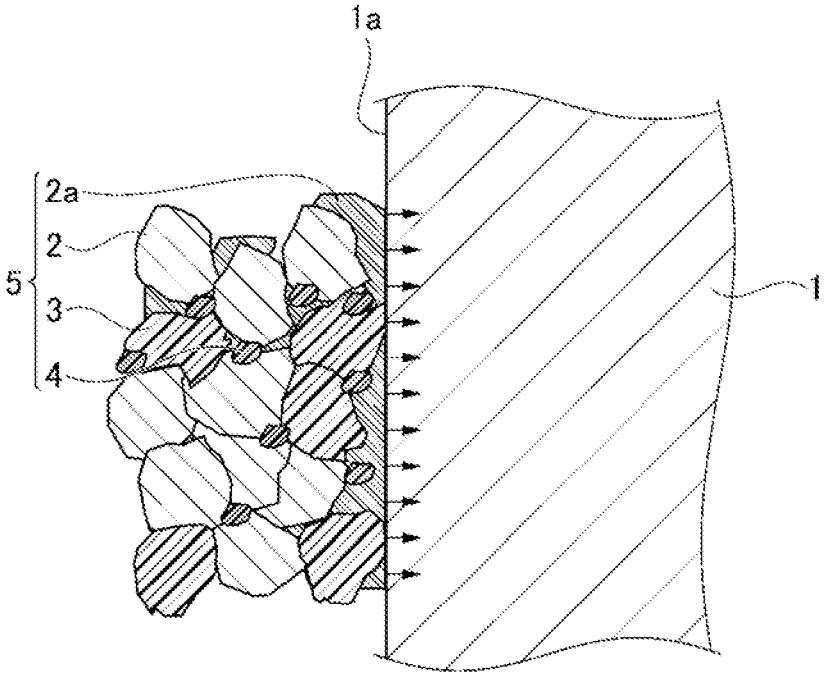
FIG. 1B is a schematic view illustrating a step subsequent to that of FIG. 1A, and is a view illustrating a step of carburizing a surface of the steel member.
Figure 2A:
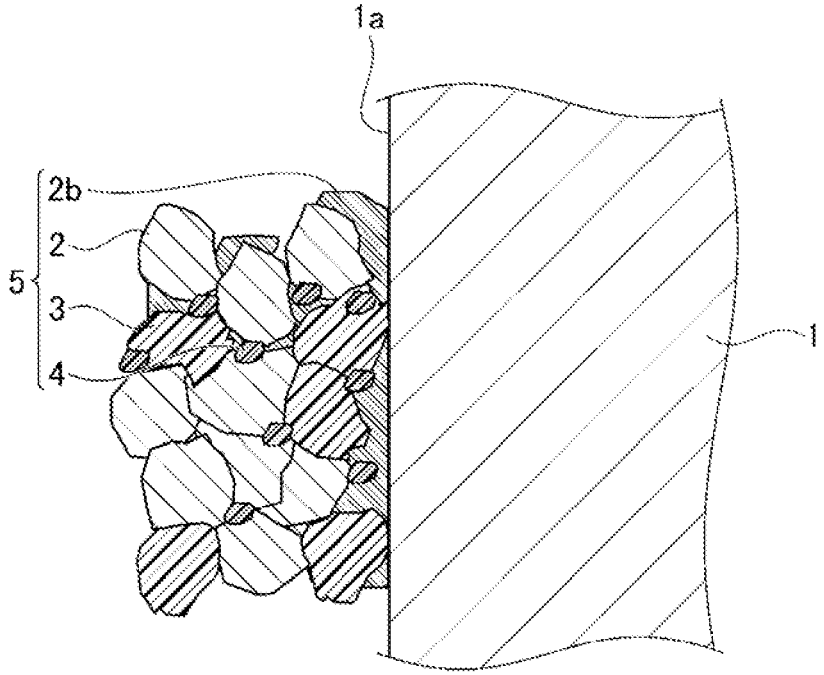
FIG. 2A is a schematic view illustrating a step after carburizing the surface of the steel member.
Figure 2B:
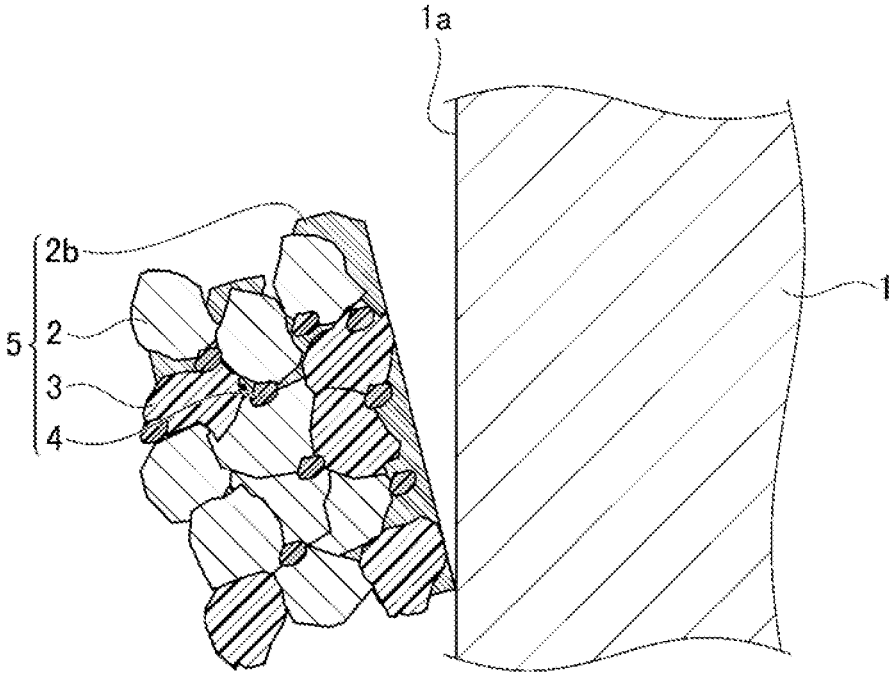
FIG. 2B is a schematic view illustrating a step of separating the carburizing agent from a surface of the steel member.

FIGS. 1A and 1B are schematic views illustrating the method for carburizing a steel member according to an embodiment of the present invention in order of steps. FIGS. 2A and 2B are schematic views illustrating steps after carburizing carbon in the steel member.

As illustrated in FIG. 1A, first, a carburizing agent 5 containing a cast iron powder (Fe-C alloy powder) 2, a graphite powder 3, and a sodium silicate solution (binder) 4 is brought into contact with at least a part of a surface 1*a* of a workpiece (steel member) The workpiece 1 is, for example, a steel member made of a case hardening steel used for a bearing or an alloy steel for a mechanical structure.

The sodium silicate solution 4 or sodium silicate binds the cast iron powders 2 to each other, the graphite powders 3 to each other, and the cast iron powder 2 and the graphite powder 3 to each other by its own adhesiveness, and fixes the cast iron powder 2 and the graphite powder 3 to the surface 1*a* of the workpiece 1. Therefore, the carburizing agent 5 is less likely to peel off from the surface 1*a* of the workpiece 1, and there is no restriction on a portion to be applied to the workpiece 1.

Thereafter, as illustrated in FIG. 1B, the workpiece 1 and the carburizing agent 5 are placed in a furnace, heated within a temperature range of art austenite region equal to or higher than the eutectic point of the steel member as the workpiece and lower than the peritectic point, and held for a certain period of time. Accordingly, a part of the cast iron powder 2 is melted (liquefied), and become a mixed state of the solid-phase cast iron powder 2, a liquid-phase cast iron portion 2*a*, the graphite powder 3, and the sodium silicate solution 4 or sodium silicate. At this time, the graphite powder 3 does not melt, but the cast iron portion 2*a* in a liquid phase spreads and comes into contact with the surface 1*a* of the workpiece 1, thereby increasing a contact area between the carburizing agent 5 and the workpiece 1. Therefore, carbon can uniformly penetrate from the surface 1*a* of the workpiece 1, and a speed of supplying carbon to the workpiece I can be greatly increased.

From the state illustrated in FIG. 1B, it is also conceivable that the solid-phase east non powder 2 is further melted, and become a mixed state of the liquid-phase cast iron portion 2*a*, the graphite powder 3, and the sodium silicate solution 4 or sodium silicate. Even in such a case, when the sodium silicate solution 4 or sodium silicate is used in the binder, sodium silicate functions as an antioxidant for the Fe-C alloy powder, and an increase in a melting temperature of the Fe-C alloy powder can be prevented.

Thereafter, as illustrated in FIG. 2A, the workpiece 1 and the carburizing agent 5 are cooled to an appropriate temperature. Accordingly, the cast iron portion 2*a* in the liquid phase state illustrated in FIG. 1B becomes a cast iron body 2*b* in a solid phase state. The method of cooling the workpiece 1 and the carburizing agent 5 is not particularly limited, and a method of cooling by leaving the workpiece 1 and the carburizing agent 5 in a furnace (furnace cooling), a method of cooling by immersing the workpiece 1 and the carburizing agent 5 in water (water cooling), a method of cooling by immersing the workpiece I and the carburizing agent 5 in oil (oil cooling), or the like can be used.

Thereafter, as illustrated in FIG. 2B, the carburizing agent 5 is separated from the surface 1*a* of the workpiece 1.

The carburizing agent used in the present embodiment and the temperature in the heating (heating temperature) during carburizing will be described in detail below.

<Heating Temperature: austenite region of steel member that is equal to or higher than eutectic point of steel member and lower than peritectic point of steel member>

In general, in carburizing to penetrate carbon from a surface of a steel and diffuse the carbon into the material, a temporal change in a carbon concentration at any depth position x is represented by the following formula (1) using Fick's second law. According to the formula (1), diffusion of carbon in the carburizing can be theoretically described.

[Formula 1]

$$C = C_0\left[1 - \mathrm{erf}\left(\frac{x}{2\sqrt{D_t}}\right)\right] \tag{1}$$

C: Carbon concentration at position x $C_0$: surface carbon concentration

D: diffusion coefficient of carbon in γ-Fe t: time

According to the above formula (1), in order to increase a carburizing rate, it is necessary to (a) increase the surface carbon concentration $C_0$, that is, increase the carbon potential in a heat treatment atmosphere, (b) perform a treatment at a high temperature at which the diffusion coefficient D is large.

Practically, carburizing within a temperature range of 930° C. to 1050° C. (a temperature range equal to or higher than A1 point and equal to or lower than a eutectic point of the case hardened steel and the alloy steel for a mechanical structure) is mainly used, and when the treatment temperature can be further increased, the carburizing time can be significantly shortened theoretically.

Therefore, the inventors of the present application have earnestly studied to stably achieve a carburizing reaction on a surface of a component in a temperature range equal to or higher than a eutectic point in order to obtain a carburizing depth of 10 mm, preferably more than 15 mm, in a short carburizing time. Accordingly, it has been found that it is effective to heat a workpiece in an austenite region of a solid phase and supply a Fe-C alloy in a mixed state of a solid phase and a liquid phase or in a liquid phase state as a carburizing agent that is a carbon source.

Figure 7:
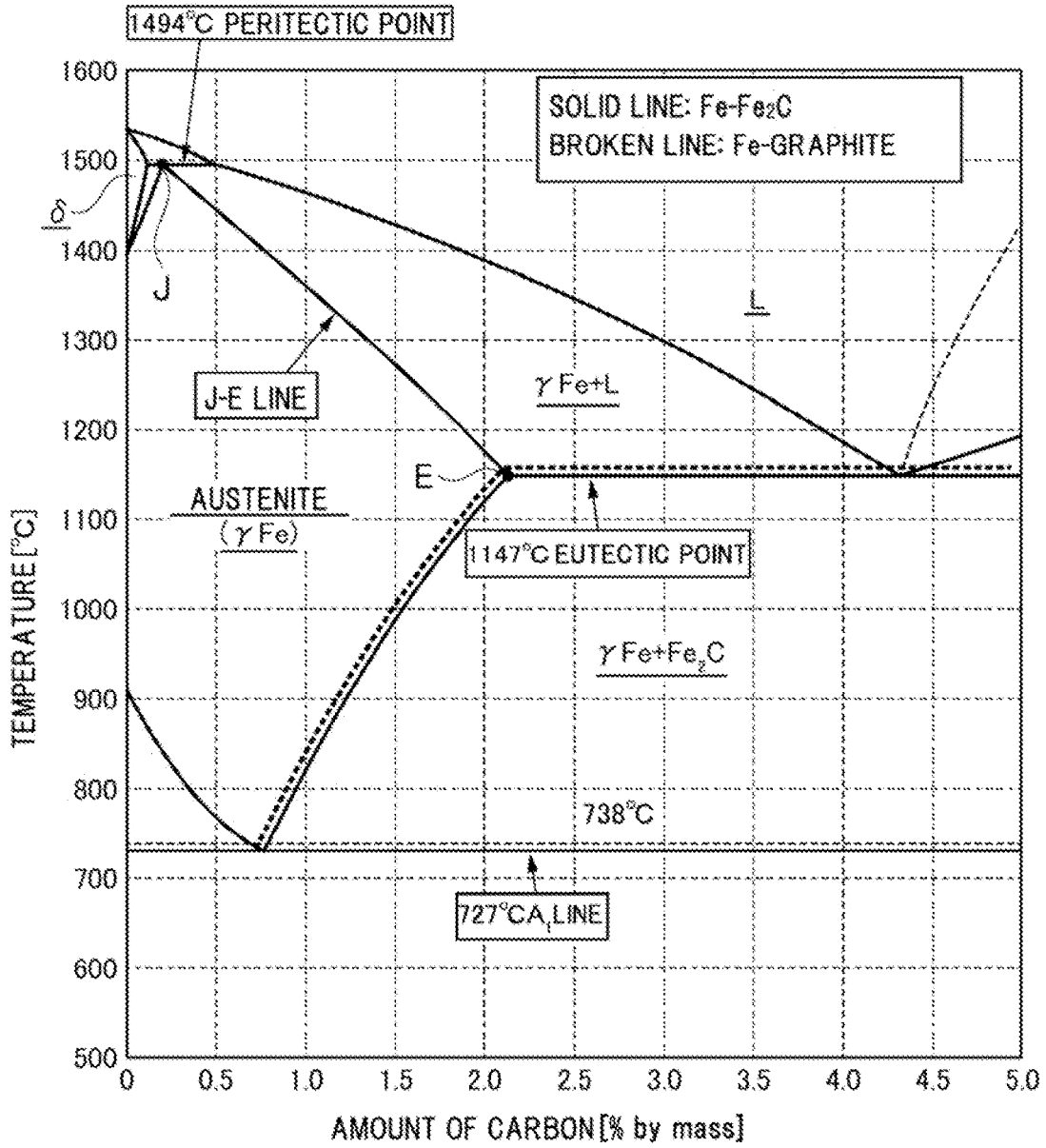
FIG. 7 is a Fe-C binary phase diagram in which a vertical axis represents temperature (° C.) and a horizontal axis represents an amount of carbon (% by mass).

According to this method, carburizing is performed when the carbon concentration of a surface of a workpiece is equal to or higher than the J-E line of the Fe-C binary phase diagram shown in FIG. 7, and the problem of generating a liquid phase, that is, excessive carburizing exceeding the solid solubility limit can be avoided, and the dissolution phenomenon can be controlled.

When the surface of the workpiece is carburized to an austenite solid solubility limit or more at a eutectic temperature or higher, a liquid phase is generated on the surface of the workpiece. Therefore, the present embodiment provides a method of carburizing in which carbon is supplied as the Fe-C alloy within the temperature range equal to or higher than the eutectic point, and in order to maintain the carbon concentration of the workpiece to be equal to or lower than the solid solubility limit concentration (J-E line in the Fe-C binary phase diagram of FIG. 5), the ingredient contained in the carburizing agent and the heating temperature are controlled to control a reaction rate on an interface with the workpiece.

That is, by using a carburizing agent to be described later and utilizing diffusion within an ultrahigh temperature range of the eutectic point or higher and the peritectic point or lower, a carburized layer having a desired uniform depth can be formed on a surface of a steel component in a large bearing in an extremely short treatment time.

As a method of heating the carburizing agent and the workpiece, high-frequency heating may also be used in addition to a heating method using a furnace.

As a specific heating temperature in the carburizing treatment, a carburizing treatment at a eutectic point or higher and a peritectic point or lower can be performed, and if the heating temperature is within this range, the treatment time can be shortened. The eutectic point and the peritectic point vary depending on the material (material composition), and the heating temperature in the carburizing treatment is preferably 1150° C. or higher, more preferably 1175° C. or higher, and still more preferably 1200° C. or higher, as long as a material is generally subjected to the carburizing treatment. The heating temperature in the carburizing treatment is preferably 1300° C. or lower, more preferably 1275° C. or lower, and still more preferably 1250° C. or lower.

Next, a carburizing agent (carburizing agent according to the present embodiment) used for the method for carburizing a steel member according to the embodiment of the present invention will be described in detail below.

[2. Carburizing Agent]

The carburizing agent according to the present embodiment is a carburizing agent that is brought into contact with at least a part of a surface of a steel member and is heated together with the steel member to allow carbon to penetrate into at least a part of the surface, and contains a Fe-C alloy powder, a graphite powder in an amount of 20% by volume or more and 70% by volume or less relative to a total volume of the carburizing agent, and a binder that binds the Fe-C alloy powder and the graphite powder to each other.

A carburizing agent according to another embodiment of the present invention is a carburizing agent that is brought into contact with at least a part of a surface of a steel member and is heated together with the steel member to allow carbon to penetrate into at least a part of the surface, and contains a Fe-C alloy powder, a graphite powder in an amount of 5% by mass or more and 60% by mass or less relative to a total mass of the carburizing agent, and a binder that binds the Fe-C alloy powder and the graphite powder to each other.

<Fe-C Alloy Powder>

As a method for carburizing a steel member according to the related art, for example, there is a method in which a surface treatment agent containing a sodium silicate solution, a carbonate, and a carbon powder, and further containing a metal oxide is used. By adding the metal oxide, a protective layer can be formed, the carbon powder and the carbonate can be diluted, and the surface treatment agent can be easily removed from a surface of a steel after the carburizing treatment on the surface is completed.

In contrast, in the present invention, a Fe-C alloy powder is used as an alternative carburizing source for the carbonate and the metal oxide (such as aluminum oxide and titanium oxide). The workpiece is heated in an austenite region of a solid phase and one of the carbon sources is regarded as a Fe-C alloy powder in a mixed state of a solid phase and a liquid phase or a liquid phase state, so that carburizing properties can be improved, As a material of the Fe-C alloy powder used for the carburizing agent, a cast iron powder, a carbon steel powder, a tool steel powder, a east iron grid, or the like may be used. A shape of the powder may be either granular or acicular, it is preferable that the amount of C in the Fe-C alloy powder serving as a carbon supply source is calculated from a range of a liquid phase appearance region (γ+L) in FIG. 1 based on the heating temperature.

When the Fe-C alloy powder is used as the carburizing agent, it is important to prevent oxidation at a high temperature. In the case where the Fe-C alloy is in the form of powder, the powder has a large surface area, and depending on the atmosphere, the melting temperature rises with decarburization of carbon in the Fe-C alloy powder, causing a problem that the carburizing source cannot be supplied in a liquid layer. Such a problem can be solved by performing the treatment in an inert gas atmosphere or mixing an antioxidant such as calcium sulfate (gypsum) with a carburizing agent. It is considered that sodium silicate itself also has an antioxidant effect. Further, it is considered that calcium sulfate itself also has an effect as a binder.

In the case where an inert gas is used, a reducing metamorphic gas mainly containing a $N_2$ or CO can be industrially used, The content of the Fe-C alloy powder in the carburizing agent is not particularly limited and is 10% by volume or more relative to the total volume of the carburizing agent, and in this case, both the carburizing property and the removability of the carburizing agent can be achieved. Therefore, the content of the Fe-C alloy powder in the carburizing agent is preferably 10% by volume or more, more preferably 40% by volume or more, and still more preferably 45% by volume or more relative to the total volume of the carburizing agent, On the other hand, when the content of the Fe-C alloy powder in the carburizing agent is 60% by volume or less relative to the total volume, of the carburizing agent, the removability of the carburizing agent tends to be good. Therefore, the content of the Fe-C: alloy powder in the carburizing agent is preferably 60% by volute or less more preferably 55% by volume or less, and still more preferably 50% by volume or less relative to the total volume of the carburizing agent.

In addition, when the content of the Fe-C alloy powder in the carburizing agent is 25% by mass or more relative to the total mass of the carburizing agent, both the carburizing property and the removability of the carburizing agent can be achieved. Therefore, the content of the Fe-C alloy powder in the carburizing agent is preferably 25% by mass or more, more preferably 50% by mass or more, and still more preferably 75% by mass or more relative to the total mass of the carburizing agent.

On the other hand, when the content of the Fe-C alloy powder in the carburizing agent is 86% by mass or less relative to the total mass of the carburizing agent, the removability of the carburizing agent tends to be good. Therefore, the content of the Fe-C alloy powder in the carburizing agent is preferably 86% by mass or less, more preferably 84% by mass or less, and still more preferably 80% by mass or less relative to the total mass of the carburizing agent.

Note that the Fe-C alloy powder that can be used in the present embodiment may contain elements other than Fe and C.

As for the particle size of the Fe-C alloy powder to be used, the small particle size is preferred because the particles are brought into contact with each other without gaps, and uniform carburizing is possible. Specifically, a Fe-C alloy powder passing through a 180-mesh sieve is preferred, a Fe-C alloy powder passing through a 150-mesh sieve is more preferred, and a Fe-C alloy powder passing through a 100-mesh sieve is still more preferred.

<Graphite Powder: 20% by volume or more and 70% by volume or less>

The carburizing agent according to the present embodiment contains a graphite powder. The graphite powder does not melt even at a temperature equal to or higher than the eutectic point, so that the graphite powder is not fixed to the workpiece and has a certain carburizing property. Therefore, by containing the graphite powder in an appropriate ratio in the carburizing agent, it is possible to obtain a carburizing agent that achieves both the carburizing property and the removability When the content of the graphite powder in the carburizing agent is less than 20% by volume relative to the total volume of the carburizing agent, removability of the carburizing agent after the steel component is carburized deteriorates. Therefore, the content of the graphite powder in the carburizing agent is 20% by volume or more, preferably 25% by volume or more, and more preferably 30% by volume or more relative to the total volume of the carburizing agent, As described above, the graphite powder has a certain carburizing property, but does not melt even in a temperature range equal to or higher than the eutectic point of the steel component. Therefore, when the content of the graphite powder in the carburizing agent is large and the content of the Fe-C alloy powder is relatively small, a contact area between the carburizing agent and the surface of the steel component decreases, and the carburization property deteriorates.

Therefore, the content of the graphite powder in the carburizing agent is 70% by volume or less, preferably 60% by volume or less, more preferably 50% by volume or less, and still more preferably 40% by volume or less relative to the total volume of the carburizing agent.

In addition, when the content of the graphite powder in the carburizing agent is less than 5% by mass relative to the total mass of the carburizing agent, removability of the carburizing agent after the steel component is carburized deteriorates. Therefore, the content of the graphite powder in the carburizing agent is 5% by mass or more, and preferably 15% by mass or more relative to the total mass of the carburizing agent.

On the other hand, when the content of the graphite powder in the carburizing agent is large and the content of the Fe-C alloy powder is relatively small, the contact area between the carburizing agent and the surface of the steel component decreases, and the carburizing property deteriorates. Therefore, the content of the graphite powder in the carburizing agent is 60% by mass or less, preferably 30% by mass or less, and more preferably 20% by mass or less relative to the total mass of the carburizing agent.

As for the particle size of the graphite powder to be used, similarly to the particle size of the Fe-C alloy powder, the small particle size is preferred because the particles are brought into contact with each other without gaps, and uniform carburizing is possible. Specifically, a graphite powder passing through a 180-mesh sieve is preferred, a graphite powder passing through a 150-mesh sieve is more preferred, and a graphite powder passing through a 100-mesh sieve is still more preferred.

<Binder>

The carburizing agent according to the present embodiment contains a binder. When the carburizing agent contains a binder, the Fe-C alloy powders can be bound to each other, the graphite powders can be bound to each other, and the Fe-C alloy powder and the graphite powder can be bound to each other, and the adhesion between the carburizing agent and the steel member can be improved. As a result, unevenness of carburizing can be prevented, and a uniform carburized layer can be obtained.

The binder is not particularly limited as long as it has a desired action, and for example, at least one of sodium silicate and calcium sulfate (gypsum) may be used. Sodium silicate may form a deoxidizing agent in a powder state.

Sodium silicate may also be used as an aqueous solution. The aqueous solution of the sodium silicate has a function of being solidified by reacting with a $CO_2$ gas in the air, and exhibits a glass state having viscosity from room temperature to a high temperature. Therefore, when the hinder contains sodium silicate in the form of an aqueous solution, the adhesion between the carburizing agent and the steel member can be further improved, and the effect of blocking oxygen can also be obtained.

In addition, when the Fe-C alloy powder and the sodium silicate solution are kneaded and supplied to the surface of the workpiece, oxidation and decarburization of the Fe-C alloy powder itself can be further prevented. Therefore, it is possible to prevent a problem that a carburizing source cannot be supplied in a liquid layer due to an increase in the melting temperature, and to obtain a more uniform carburized layer.

In the case where a sodium silicate solution is used as the hinder, water glass of No. 1 to No. 3 (sodium silicate aqueous solution), sodium metasilicate No. 1, No. 2 (crystal), and the like can be used as the sodium silicate and an aqueous solution thereof as described in JIS K1408 (1964).

The content of the binder in the carburizing agent is not particularly limited, and in the case where sodium silicate is used as the binder, adhesion between the carburizing agent and the steel member can be improved when the content of the binder in the carburizing agent is 4% by mass or more relative to the total mass of the carburizing agent. The content of the binder is preferably 0.1% by mass or more relative to the mass of the cast iron powder in the carburizing agent.

On the other hand, when the content of the binder in the carburizing, agent is 40% by mass or less relative to the total mass of the carburizing agent, the content of the Fe-C alloy powder and the graphite powder in the carburizing agent can be sufficiently ensured, and therefore an excellent carburizing property can be obtained. Therefore, the content of the binder in the carburizing agent is preferably 40% by mass or less, more preferably 25% by mass or less, and still more preferably 20% by mass or less relative to the total mass of the carburizing agent. As sodium silicate, either a liquid form (a sodium silicate solution) or a powdery form may be used. When the sodium silicate solution is used, the content represents the mass of the sodium silicate solution relative to the total mass of the carburizing agent.

In the case where the binder to be used is a powder, similarly to the particle size of the Fe-C alloy powder, the small particle size is preferred because the particles are brought into contact with each other without gaps, and uniform carburizing is possible. Specifically, a powder passing through a 180-mesh sieve is preferred, a powder passing through a 150-mesh sieve is more preferred, and a powder passing through a 100-mesh sieve is still more preferred.

In addition, similarly to sodium silicate, calcium sulfate (gypsum) can bind Fe-C alloy powders to each other, graphite powders to each other, and Fe-CT alloy powder and graphite powder to each other, and can improve adhesion between the carburizing agent and the steel member. When calcium sulfate is contained in the binder, oxygen blocking performance can also be obtained, and therefore, carburizing can be performed with a carburizing agent in a non-oxidized state to an extremely low oxidized state.

Depending on the carburizing method according to the present embodiment using the carburizing agent, a state higher than the carbon potential of gas carburizing can he maintained, rapid and uniform carburizing can be implemented, and the carburizing agent after carburizing can be easily removed.

The method for carburizing according to the present embodiment is also suitable, for example, in a case where a carburizing treatment is performed on a bearing ring and a rolling element of an ultra-large roller bearing for industrial machines, which have an outer diameter of more than 1000 mm and the steel member targeted by the present invention is not limited to have such a size, and the method for carburizing can be applied to steel members of various sizes.

[3. Steel Component]

Next, a steel component carburized according to the method for carburizing the steel member will be described below. A steel component according to the present embodiment is a steel component obtained by bringing a carburizing agent into contact with at least a part of a surface of a steel member and heating the steel member to allow carbon to penetrate into at least a part of the surface, in which the carburizing agent includes a Fe-C alloy powder, a graphite powder in an amount of 20% by volume or more and 70% by volume or less relative to a total volume of the carburizing agent, and a binder for binding the Fe-C alloy powder and the graphite powder to each other, and a temperature of the is in an austenite region of a eutectic point or higher and lower than a peritectic point of the steel component, and the steel component is held at the temperature of the heating for a certain period of time.

It should be noted that the steel component has a uniform carburized layer with a desired depth after the carburizing agent on the surface is removed. The ingredients contained in the carburizing agent for obtaining the steel component, the contents thereof, the heating conditions, and the like are the same as those described in the method for carburizing and the carburizing agent for the steel member, and thus detailed descriptions thereof will be omitted.

[Example 1]

In order to check the effect of the present invention, a small test piece simulating a carburizing treatment of a steel member (bearing ring and rolling element) constituting a large bearing was produced, and the following experiment was performed.

Figure 3:
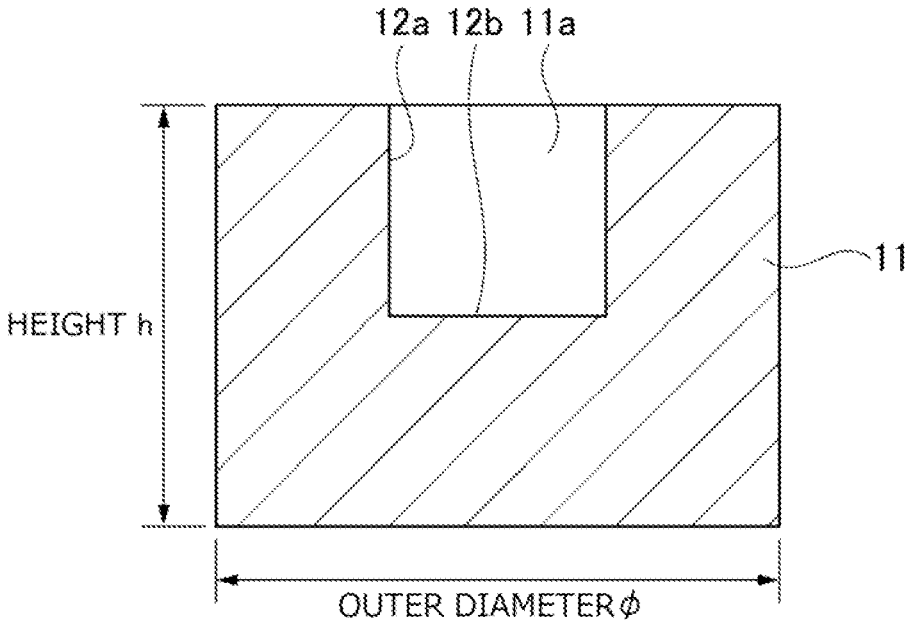
FIG. 3 is a schematic view illustrating a shape and a size of a test piece used in Examples.

FIG. 3 is a schematic view illustrating a shape and a size of a test piece used in the present Example. As a material of a test piece (steel member) II, an SCR420 steel (carbon: 0.18 to 0.23%, median: 0.205%) of JIS4053 (alloy steel for mechanical structure) was selected. Regarding the size of the test piece 11, the test piece 11 had a cylindrical shape having an outer diameter ϕ of 40 mm, 30 mm, or 20 mm, a height h of 17.5 mm, 22.5 mm, 25 mm, or 30 mm, and a blind hole 11*a* having an inner diameter of 15 mm and a depth of 15 mm at a center of an upper surface.

<Test 1>

Carburizing agents haying a graphite powder whose volume fraction was variously changed were prepared, and a carburizing treatment was performed on the test piece to evaluate the surface carbon concentration and the carburizing agent removability.

As a test method, first, a carburizing agent obtained by mixing a cast iron powder (Fe-C alloy powder), a graphite powder, and sodium silicate (binder) at a volume ratio shown in Table 1 below was placed in the blind hole 11*a*, and the carburizing agent was brought into contact with surfaces (a side surface 12*a* and a bottom surface 12*b*) of the blind hole 11*a*. Next, as a heating step, the test piece was heated in a nitrogen gas atmosphere, and in this state, the test piece was held for 5 minutes or 900 minutes to be subjected to a carburizing treatment, and cooling was performed in a furnace. The temperature in the heating was set to 1200° C., which is an intermediate temperature between 1147° C. as the eutectic point of the SCR 420 steel and 1494° C. as the peritectic point of the SCR 420 steel, based on the Fe-C binary phase diagram shown in FIG. 7.

The carburizing agent placed in the blind hole 11*a* of the obtained test piece 11 was removed, followed by cutting the test piece 11 along a plane passing through a center line passing through a cylindrical axis, a cross-sectional macro was observed with a stereo microscope to evaluate removability of the carburizing agent, and a surface carbon concentration was measured with an electron probe micro analyzer (EPMA). Regarding the surface carbon concentration measured by EPMA, measurement was performed at a center of the bottom surface of the blind hole 11 a in the test piece 11, and measurement was performed at any position of the side surface, which is at a center of the distance from a top surface to the bottom surface. When the surface carbon concentration was 0.80% by mass or more, it was determined that the carburizing property was excellent.

In addition, the removability of the carburizing agent was evaluated by a method of scraping out the carburizing agent from the test piece after carburizing with a scraping-out rod having a tip end with a spoon shape, and a case in which most of the carburizing agent could be removed by one scraping-out treatment and which had no influence on a subsequent process was evaluated as "A" (good), and a case in which the carburizing agent remained even when the scraping-out treatment was per brined a plurality of times and a mechanical removal treatment was required was evaluated as "B" (poor). The evaluation results are also shown in Table 1 below.

In Table 1 below, the C concentration of the carburizing agent is a value calculated by the following formula (2).

C concentration of carburizing agent=C mass in cast iron powder+C mass in graphite powder)/(mass of cast iron powder+mass of graphite powder) . . . (2)

Here, the cast iron powder used in the present Example contains 3.1% by mass of C, and the graphite powder contains 100% by mass of C.

TABLE 1

| | | Test conditions | | | | | | Evaluation results | | |
|---|---|---|---|---|---|---|---|---|---|---|
| | | Size of test piece Diameter ϕ (mm)/ height h (mm) | Heat treatment conditions Temperature (° C.)-time (min) | C concentration of carburizing agent (% by mass) | Ingredient of carburizing agent (% by volume) | | | Surface carbon concentration (% by mass) | | Carburizing agent removability |
| | No | | | | Cast iron powder | Graphite powder | Sodium silicate | Bottom surface | Side surface | |
| Examples | 1 | 40 × 30 | 1200° C.-5 min | 12 | 60 | 20 | 20 | 1.10 | 1.00 | A |
| | 2 | 40 × 30 | 1200° C.-5 min | 20 | 46 | 32 | 22 | 1.20 | 1.20 | A |
| | 3 | 40 × 30 | 1200° C.-5 min | 69 | 10 | 70 | 20 | 0.80 | 0.80 | A |

TABLE 1-continued

| | | Test conditions | | | | | | Evaluation results | | |
|---|---|---|---|---|---|---|---|---|---|---|
| | | Size of test piece Diameter φ (mm)/ height h (mm) | Heat treatment conditions Temperature (° C.)-time (min) | C concentration of carburizing agent (% by mass) | Ingredient of carburizing agent (% by volume) | | | Surface carbon concentration (% by mass) | | Carburizing agent removability |
| No | | | | | Cast iron powder | Graphite powder | Sodium silicate | Bottom surface | Side surface | |
| Comparative Examples | 4 | 40 × 30 | 1200° C.-5 min | 7 | 70 | 10 | 20 | 1.25 | 1.20 | B |
| | 5 | 20 × 17.5 | 1200° C.-900 min | 100 | 0 | 100 | 0 | 0.60 | — | A |
| | 6 | 40 × 30 | 1200° C.-5 min | 20 | 59 | 41 | 0 | 0.60 | 0.40 | A |
| | 7 | 30 × 22.5 | 1200° C.-5 min | 3.1 | 78 | 0 | 22 | 1.30 | — | B |

As shown in Table 1 above, in Example No. 1, a carburizing agent prepared at a mixing ratio of cast iron powder: graphite powder: sodium silicate=60:20:20 (% by volume) was used, and the content of the graphite powder was within the range of the present invention. Therefore, the surface carbon concentrations of the bottom surface and the side surface were 1.10% by mass and 1.00% by mass, respectively, and an excellent carburizing property could be obtained. In addition, the carburizing agent after carburizing could be easily removed.

In Example No. 2, a carburizing agent prepared at a mixing ratio of cast iron powder: graphite powder: sodium silicate=46:32:22 (% by volume) was used, and the content of the graphite powder was within the range of the present invention. Therefore, the surface carbon concentrations of the bottom surface and the side surface were 1.20% by mass and 1.20% by mass, respectively, and an excellent carburizing property could be obtained. In addition, the carburizing agent after carburizing could be easily removed.

In Example No. 3, a carburizing agent prepared at a mixing ratio of cast iron powder: graphite powder: sodium silicate=10:70:20 (% by volume) was used, and the content of the graphite powder was within the range of the present invention. Therefore, the surface carbon concentrations of the bottom surface and the side surface were 0.80% by mass and 0.80% by mass, respectively, and an excellent carburizing property could be obtained. In addition, the carburizing agent after carburizing could be easily removed.

In contrast, in Comparative Example No. 4, a carburizing agent prepared at a mixing ratio of cast iron powder: graphite powder: sodium silicate=70:10:20 (vol. %) was used, and the content of the graphite powder is less than the lower limit of the range of the present invention. Therefore, the surface carbon concentrations of the bottom surface and the side surface were 1.25% by mass and 1.20% by mass, respectively, and an excellent carburizing property could be obtained, but the carburizing agent after carburizing could not be easily removed.

In Comparative Example No. 5, a carburizing agent prepared at a mixing ratio of cast iron powder: graphite powder: sodium silicate=0:100:0 (% by volume) was used, and the content of the graphite powder exceeds the upper limit of the range of the present invention. Therefore, the surface carbon concentration of the bottom surface was 0.60% by mass, and the carburizing property was reduced as compared with Examples. However, it is considered that the graphite powder has not only an effect of improving removability of the carburizing agent but also an effect of obtaining a certain carburizing property.

In Comparative Example No. 5, a test piece for evaluating the carburizing property and removability of the single graphite powder was used, and thus the carbon concentration of the side surface was not measured.

In Comparative Example No. 6, a carburizing agent prepared at a mixing ratio of cast iron powder: graphite powder: sodium silicate=59:41:0 (% by volume) was used, and sodium silicate (binder) was not contained. Therefore, although the carburizing agent after carburizing could be easily removed, the surface carbon concentrations of the bottom surface and the side surface were 0.60% by mass and 0.40% by mass, respectively, and an excellent carburizing property could not be obtained.

Figure 4A:
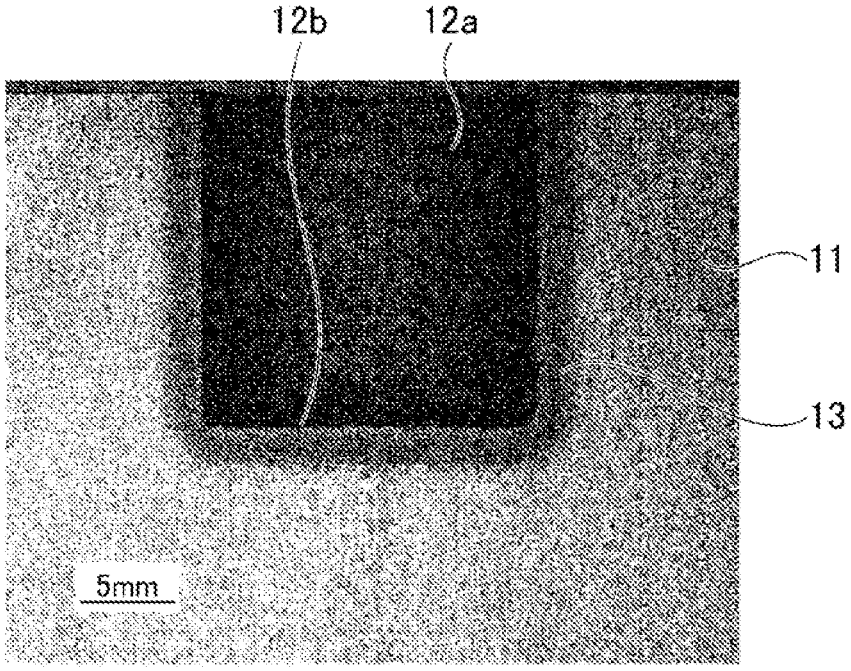
FIG. 4A is a photograph as a substitute for a drawing, which illustrates a carburized layer of a test piece of Example No. 2 after removal of the carburizing agent.
Figure 4B:
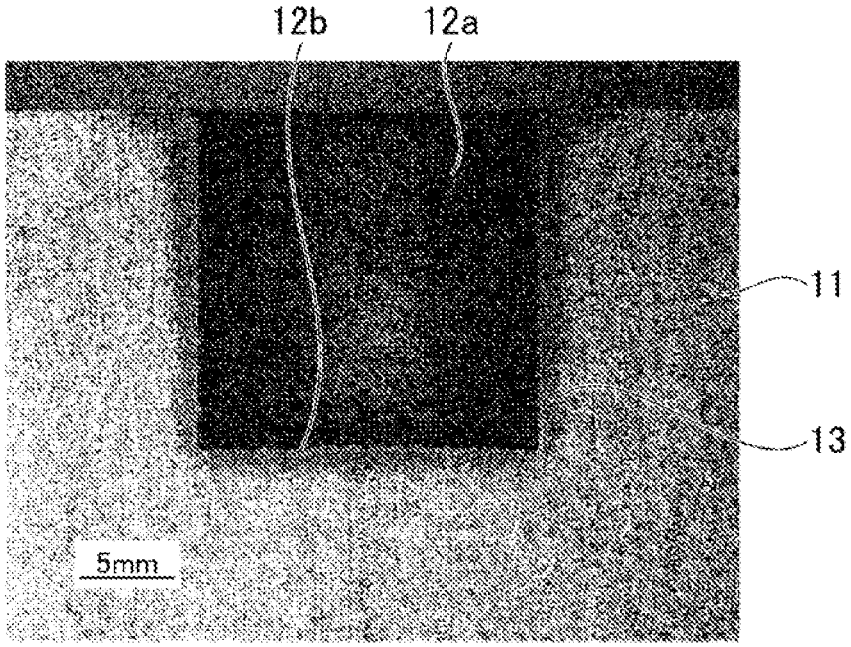
FIG. 4B is a photograph as a substitute for a drawing, which illustrates a carburized layer of a test piece of Comparative Example No. 6 after removal of the carburizing agent.

FIG. 4A is a photograph as a substitute for a drawing, which illustrates a carburized layer of a test piece of Example No. 2 after removal of the carburizing agent. FIG. 4B is a photograph as a substitute for a drawing, which illustrates a carburized layer of a test piece of Comparative Example No. 6 after removal of the carburizing agent.

In Example No. 2 and Comparative Example No. 6, the C concentration of the carburizing agent was the same value, but the surface carbon concentration of Example No. 2 was higher than the surface carbon concentration of Comparative Example No. 6 As shown 5 in FIGS. 4A and 4B, regarding Example No. 2, a uniform carburized layer 13 could be confirmed on an entire surface of the bottom surface 12*b* and the side surface 12*a*, but regarding Comparative Example No. 6, a carburized layer 13 was non-uniform, This result indicates that sodium silicate is effective in carburizing unevenness. That is, it is considered that when sodium silicate is contained in the carburizing agent, the adhesion of an interface between the carburizing agent and the steel member is improved and decarburization is prevented, and as a result, carburizing unevenness is prevented.

In Comparative Example No. 7, a carburizing agent prepared at a mixing ratio of cast iron powder: graphite powder: sodium silicate=78:0:22 (% by volume) was used, and the graphite powder was not contained. Therefore, it was not possible to easily remove the carburizing agent after carburizing.

In Comparative Example No. 7, the surface carbon concentration of the bottom surface was 1.30% by mass, and an excellent carburizing property could be obtained, but the surface carbon concentration of the side surface was not measured because the carburizing agent was melted and was less likely to be removed.

Figure 5A:
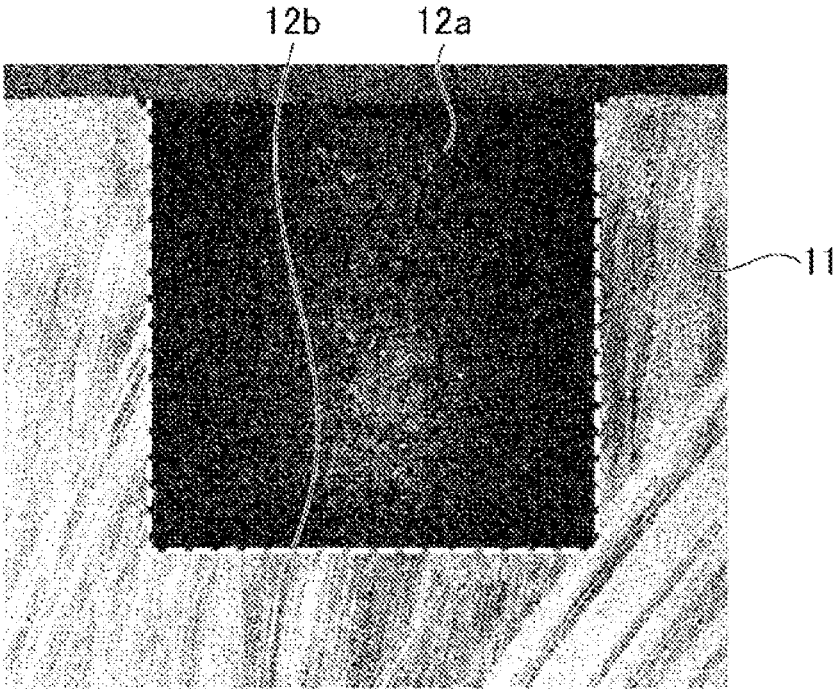
FIG. 5A is a photograph as a substitute for a drawing, which illustrates a carburized agent in the test piece of Example No. 2 after removal of the carburizing agent.
Figure 5B:
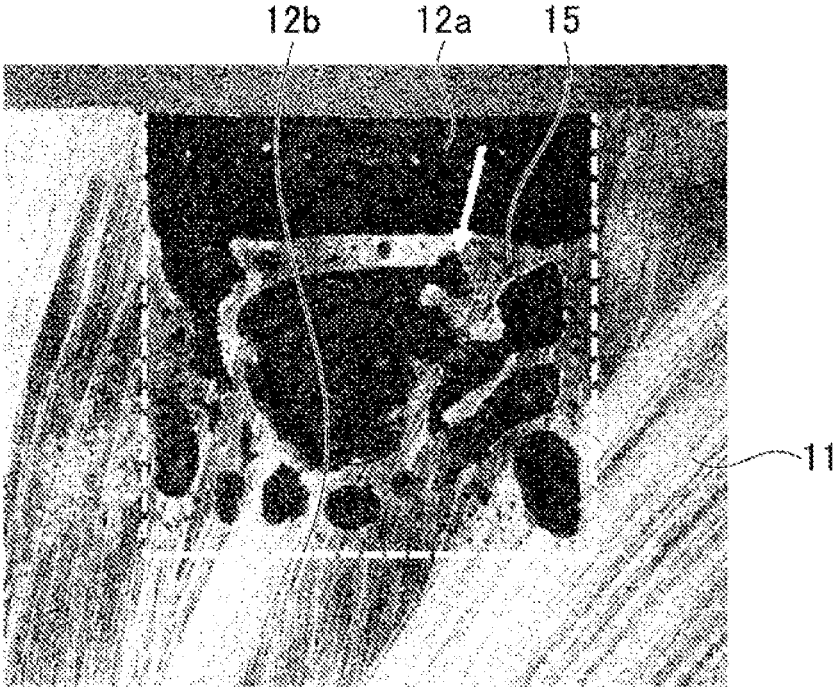
FIG. 5B is a photograph as a substitute for a drawing, which illustrates a carburizing agent in a test piece of Comparative Example No. 7 after removal of the carburizing agent.
Figure 6:
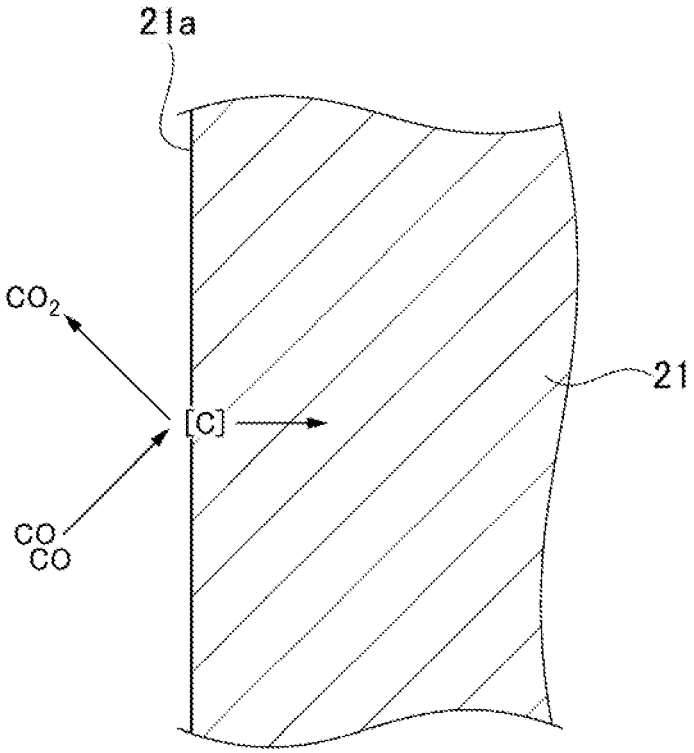
FIG. 6 is a schematic view illustrating a carburizing mechanism of a gas carburizing method.

FIG. 5A is a photograph as a substitute for a drawing, which illustrates a carburizing agent in the test piece of Example No. 2 after removal of the carburizing agent. FIG. 5B is a photograph as a substitute for a drawing, which illustrates a carburizing agent in a test piece of Comparative Example No. 7 after removal of the carburizing agent.

In Example No. 2 and Comparative Example No. 7, the surface carbon concentrations of the bottom surfaces were the same, but in Example No. 2, the removability of the carburizing agent was excellent, and the carburizing agent did not remain on the bottom surface 12*b* and the side surface 12*a*. In contrast, regarding Comparative Example No. 7, the removability of the carburizing agent was poor, and a carburizing agent 15 was welded to the bottom surface 12*b* and the side surface 12*a*, and could not be removed even using a scrape-off rod having a tip end with a spoon shape. It should be noted that a portion indicated by an arrow in FIG. 5B indicates the carburizing agent that was welded and could not be removed, These results show that the graphite powder has an effect of improving removability of the carburizing agent. The graphite powder has a high melting point and maintains a granular shape even at a test temperature of 1200° C. Therefore, the carburizing agent is considered to be easily removed.

In Examples No. 1 to 3 and Comparative Examples No. 4 to 7, the contents of the cast iron powders and the graphite powders are changed in a stepwise manner, From these results, it can be seen that as the ratio of the cast iron powder in the carburizing agent increases, the carburizing property tends to improve (the surface carbon concentration increases), but the removability of the carburizing agent decreases.

<Test 2>

The mass fraction of each ingredient of the carburizing agent used in Test 1 was measured and compared with the volume fraction shown in Table 1. The test conditions and evaluation results are shown in Tables 2 and 3 below. Conditions and evaluation results other than the mass fraction of each ingredient of the carburizing agent in Test 2 are the same as those shown in Table 1 above, and are also shown in Tables 2 and 3 below for comparison with the evaluation results of Test 3 and Test 4 shown below.

<Test 3>

A carburizing agent having sodium silicate whose mass fraction was variously changed was prepared using powdery sodium silicate, and the test piece was subjected to a carburizing treatment to evaluate the surface carbon concentration and the carburizing agent removability. In Test 3, cooling (water cooling) was performed by immersing the test piece in water after the heat treatment. The test method and the evaluation method were the same as those in Test 1.

<Test 4>

A test piece was subjected to a carburizing treatment after changing the bulk density of a carburizing agent by changing the packing degree of the carburizing agent, thereby evaluating the surface carbon concentration and the carburizing agent removability. In Test 4, cooling (water cooling) was performed by immersing the test piece in water after the heat treatment. As the binder, liquid sodium silicate was used. The test method and the evaluation method were the same as those in Test 1.

Test conditions and evaluation results of Test 3 and Test 4 are also shown in Tables 2 and 3 below. In Test 3, the volume fraction was also measured and shown. In Test 4, the 5 volume fraction was not measured, and only the mass fraction was shown.

TABLE 2

| | | | Test conditions | | | | |
|---|---|---|---|---|---|---|---|
| | | No. | Size of test piece Diameter ϕ (mm) × height h (mm) | Heat treatment conditions Temperature (° C.)-time (min)→cooling method | C concentration of carburizing agent (% by mass) | Bulk density of carburizing agent (g/cm$^3$) | Mixing temperature (° C.) |
| Test 2 | Examples | 1 | 40 × 30 | 1200° C.-5 min→ furnace cooling | 12 | — | Room temperature |
| | | 2 | 40 × 30 | 1200° C.-5 min→ furnace cooling | 20 | — | Room temperature |
| | | 3 | 40 × 30 | 1200° C.-5 min→ furnace cooling | 69 | — | Room temperature |
| | Comparative Examples | 4 | 40 × 30 | 1200° C.-5 min→ furnace cooling | 7 | — | Room temperature |
| | | 5 | 20 × 17.5 | 1200° C.-900 min→ furnace cooling | 100 | — | Room temperature |
| | | 6 | 40 × 30 | 1200° C.-5 min→ furnace cooling | 20 | — | Room temperature |
| | | 7 | 30 × 22.5 | 1200° C.-5 min→ furnace cooling | 3.1 | — | Room temperature |
| Test 3 | Examples | 8 | 20 × 25 | 1200° C.-5 min→ water cooling | 20 | — | Room temperature |
| | | 9 | 20 × 25 | 1200° C.-5 min→ water cooling | 20 | — | Room temperature |
| | | 10 | 20 × 25 | 1200° C.-5 min→ water cooling | 20 | — | Room temperature |
| Test 4 | Examples | 11 | 20 × 25 | 1200° C.-5 min→ water cooling | 20 | 1.3 | Room temperature |
| | | 12 | 20 × 25 | 1200° C.-5 min→ water cooling | 20 | 2.0 | Room temperature |
| | | 13 | 20 × 25 | 1200° C.-5 min→ water cooling | 20 | 2.8 | Room temperature |

TABLE 3

| | | | Test conditions | | | | | | | | Evaluation results | | |
|---|---|---|---|---|---|---|---|---|---|---|---|---|---|
| | | | Ingredient of carburizing agent (% by mass) | | | | Ingredient of carburizing agent (% by volume) | | | | Surface carbon concentration (% by mass) | | |
| | | | Cast iron powder | Graphite powder | Sodium silicate Liquid | Sodium silicate Powder | Cast iron powder | Graphite powder | Sodium silicate Liquid | Sodium silicate Powder | Bottom surface | Side surface | Carburizing agent removability |
| Test 2 | Examples | 1 | 84 | 9 | 7 | 0 | 60 | 20 | 20 | 0 | 1.10 | 1.00 | A |
| | | 2 | 75 | 16 | 9 | 0 | 46 | 32 | 22 | 0 | 1.20 | 1.20 | A |
| | | 3 | 28 | 59 | 13 | 0 | 10 | 70 | 20 | 0 | 0.80 | 0.80 | A |
| | Comparative Examples | 4 | 90 | 4 | 6 | 0 | 70 | 10 | 20 | 0 | 1.25 | 1.20 | B |
| | | 5 | 0 | 100 | 0 | 0 | 0 | 100 | 0 | 0 | 0.60 | — | A |
| | | 6 | 83 | 18 | 0 | 0 | 59 | 41 | 0 | 0 | 0.60 | 0.40 | A |
| | | 7 | 91 | 0 | 9 | 0 | 78 | 0 | 22 | 0 | 1.30 | — | B |
| Test 3 | Examples | 8 | 79 | 17 | 0 | 4 | 55 | 38 | 0 | 8 | 1.70 | 1.80 | A |
| | | 9 | 78 | 17 | 0 | 5 | 53 | 37 | 0 | 10 | 1.70 | 1.60 | A |
| | | 10 | 77 | 16 | 0 | 7 | 51 | 35 | 0 | 14 | 1.70 | 1.60 | A |
| Test 4 | Examples | 11 | 75 | 16 | 9 | 0 | — | — | — | — | 1.80 | 1.00 | A |
| | | 12 | 75 | 16 | 9 | 0 | — | — | — | — | 1.70 | 1.40 | A |
| | | 13 | 75 | 16 | 9 | 0 | — | — | — | — | 1.70 | 1.50 | A |

As shown in Tables 2 and 3, in Examples No. 1 to No. 3 and No. 8 to No. 13, a carburizing treatment was performed on a test sample according to the method for carburizing a steel member according to the present invention using a carburizing agent having a graphite powder content (% by mass) within the range of the present invention. In Examples No. 1 to No. 3 and No. 8 to No. 10, the volume fraction of the graphite powder was also measured, and all of them were within the range of the present invention. Therefore, the surface carbon concentration of each of the bottom surface and the side surface was 0.80% by mass or more, and an excellent carburizing property could be obtained. In addition, the carburizing agent after carburizing could be easily removed.

In contrast, in Comparative Examples No. 4 to No. 7, the mass fraction and the volume fraction of the graphite powder in the carburizing agent were out of the range of the present invention, or the carburizing agent not containing sodium silicate (binder) was used, so that the carburizing property or the carburizing agent removability was poor.

Note that, as shown in Test 4 (Examples No. 11 to No. 13), it was found that even when the bulk density of the carburizing agent was changed, the carburizing property and the carburizing agent removability were not greatly affected. However, if the bulk density of the carburizing agent is too small, the carburizing agent is less likely to adhere to the surface of the workpiece, and there is a possibility that variation occurs in quality, and therefore, the bulk density of the carburizing agent is preferably 1.0 (g/cm$^3$) or more.

As shown in the above Examples and Comparative Examples, according to the method for carburizing a steel member according to the present embodiment, diffusion in an ultrahigh temperature range of a eutectic point or higher and a peritectic point or lower can be utilized, and more rapid and uniform carburizing can be performed in a large bearing.

Although the embodiments are described above with reference to the drawings, it is needless to say that the present invention is not limited to such examples. It will be apparent to those skilled in the art that various changes and modifications may be conceived within the scope of the claims. It is also understood that the various changes and modifications belong to the technical scope of the present invention. Constituent elements in the embodiments described above may be combined freely within a range not departing from the spirit of the present invention.

REFERENCE SIGNS LIST

1 Workpiece
2 Cast iron powder
**2*b*** Cast iron portion
3 Graphite powder
4 Sodium silicate solution
5 Carburizing agent
11 Test piece
13 Carburized layer
15 Carburizing agent
21 Steel member

The invention claimed is:

1. A method for carburizing a steel member, the method comprising:

bringing a carburizing agent into contact with at least a part of a surface of a steel member; and heating the steel member and the carburizing agent to allow carbon to penetrate into at least a part of the surface, wherein the carburizing agent contains a Fe-C alloy powder, a graphite powder in an amount of 20% by volume or more and 70% by volume or less relative to a total volume of the carburizing agent, and a binder that binds the Fe-C alloy powder and the graphite powder to each other, and in the heating, a heating temperature is held for a certain period of time within a temperature range of an austenite region equal to or higher than a eutectic point of the steel member and lower than a peritectic point of the steel member.

2. The method for carburizing a steel member according to claim 1, wherein the Fe-C alloy powder is in a mixed state of a solid phase and a liquid phase or in a liquid-phase state at a temperature equal to or higher than the eutectic point of the steel member, and the graphite powder is in a solid-phase state at a temperature equal to or higher than the eutectic point of the steel member.

3. The method for carburizing a steel member according to claim 1, wherein the binder contains at least one of sodium silicate and calcium sulfate.

4. The method for carburizing a steel member according to claim 1, wherein the heating is performed in an inert gas atmosphere.

5. A carburizing agent for use in the method for carburizing a steel member according to claim 1, the carburizing agent comprising:

a Fe-C alloy powder;

a graphite powder in an amount of 20% by volume or more and 70% by volume or less relative to a total volume of the carburizing agent; and a binder that binds the Fe-C alloy powder and the graphite powder to each other.

6. A method for carburizing a steel member, the method comprising:

bringing a carburizing agent into contact with at least a part of a surface of a steel member; and heating the steel member and the carburizing agent to allow carbon to penetrate into at least a part of the surface, wherein the carburizing agent contains a Fe-C alloy powder, a graphite powder in an amount of 5% by mass or more and 60% by mass or less relative to a total mass of the carburizing agent, and a binder that binds the Fe-C alloy powder and the graphite powder to each other, and in the heating, a heating temperature is held for a certain period of time within a temperature range of an austenite region equal to or higher than a eutectic point of the steel member and lower than a peritectic point of the steel member.

7. The method for carburizing a steel member according to claim 5, wherein the Fe-C alloy powder is in a mixed state of a solid phase and a liquid phase or in a liquid-phase state at a temperature equal to or higher than the eutectic point of the steel member, and the graphite powder is in a solid-phase state at a temperature equal to or higher than the eutectic point of the steel member.

8. The method for carburizing a steel member according to claim 6 or wherein the binder contains at least one of sodium silicate and calcium sulfate.

9. The method for carburizing a steel member according to claim 5, wherein the heating step is performed in an inert gas atmosphere.

10. A carburizing agent for use in the method for carburizing a steel member according to claim 5, the carburizing agent comprising:

a Fe-C alloy powder;

a graphite powder in an amount of 5% by mass or more and 60% by mass or less relative to a total mass of the carburizing agent; and a binder that binds the Fe-C alloy powder and the graphite powder to each other.

* * * * *